United States Patent [19]

MacBean

[11] 4,438,789

[45] Mar. 27, 1984

[54] WOVEN PIN SEAM IN FABRIC AND METHOD

[75] Inventor: Donald G. MacBean, Ottawa, Canada

[73] Assignee: JWI Ltd., Kanata, Canada

[21] Appl. No.: 502,132

[22] Filed: Jun. 8, 1983

Related U.S. Application Data

[63] Continuation of Ser. No. 270,341, Jun. 4, 1981, abandoned, which is a continuation-in-part of Ser. No. 214,738, Dec. 9, 1980, abandoned.

[51] Int. Cl.[3] ..... D03D 3/04

[52] U.S. Cl. ..... 139/383 A

[58] Field of Search ..... 139/383 R, 383 A, 383 AA, 139/425 A

[56] References Cited

U.S. PATENT DOCUMENTS

| | | | |
|---|---|---|---|
| 4,026,331 | 5/1977 | Lees et al. | 139/383 AA |
| 4,286,631 | 9/1981 | Strandly | 139/383 A |
| 4,290,209 | 9/1981 | Buchanan et al. | 139/383 A |

FOREIGN PATENT DOCUMENTS

| | | | |
|---|---|---|---|
| 47-43762 | 11/1972 | Japan | 139/383 A |

*Primary Examiner*—Henry Jaudon

*Attorney, Agent, or Firm*—Alan Swabey; Robert Mitchell; Guy J. Houle

[57] ABSTRACT

The invention relates to a woven all-synthetic monofilament dryer fabric for use in a paper-making machine. The fabric is constituted by a belt woven with warp and weft strands with the warp strands extending in the machine direction. The belt is interconnected at opposed ends by a woven single pintle pin seam to form an endless belt. The warp strands in at least rewoven end portions of the belt are flattened strands.

17 Claims, 3 Drawing Figures

WOVEN PIN SEAM IN FABRIC AND METHOD

This is a continuation application of application Ser. No. 270,341, filed June 4, 1981 which application is a continuation-in-part of application Ser. No. 214,738, filed Dec. 9, 1980, both now abandoned.

BACKGROUND OF INVENTION (a) Field of Invention

This invention relates to dryer fabrics woven entirely of monofilament polymeric warp and weft strands and more particularly to joining the ends of such fabric with a woven pin seam to form an endless belt.

(b) Description of Prior Art

A dryer fabric is usually woven as a long, wide, flat single piece and when it is installed on a paper machine the ends are joined by means of a plurality of loops provided at each end edge which are interdigitated to form an elongated passageway through which a pintle pin is inserted to form a hinge-type joint known in the paper-making trade as a pin seam.

There are several known methods of providing the plurality of loops at the end edges of the fabric and the one which is generally accepted as being the most satisfactory for monofilament dryer fabrics is the woven pin seam.

To make a woven pin seam ia predetermined number of weft strands is removed at each end of the fabric to leave projecting crimped warp strands. Alternating projecting warp strands are folded back and interwoven, in an adjacent position, into a plurality of added weft strands which are crimped similarly to those that were removed, thus forming a reconstituted woven area at each end of the fabric. In the process, selected ones of the folded back warp strands are bent around a loop-forming rod placed near the last added weft strand to form pintle loops and the remaining folded back warp strands are bent around the last added weft strand to form retaining loops. All woven back warp strands meet the ends of adjacent warp strands which have been woven part way into the group of added weft strands and, when clipped off closely to the surface of the fabric, form abutting termination points at various distances from the last weft strand in a predetermined uniform pattern throughout the reconstituted fabric of the seam area.

The advantages of the woven pin seam are that the continuity of the mesh at each end of the fabric, right up to the pintle loops, is maintained without a discernable mesh blockage and without a layered thickness where the fabric is folded back and sewn to provide loops in a de-wefted section or a specially prepared short section of fabric, provided with loops, is sewn to each end of the dryer fabric. Also the strength of the woven pin seam is reasonably controllable, being determined by the number of the looped warp strands and by the number of added weft strands through which the crimped warp strands are interwoven.

It is characteristic of the conventional round plastic warp strands of a heat set monofilament synthetic fabric to be permanently crimped and when these strands are unwoven the crimp remains and resists attempts to alter its configuration. Therefore, the success in making a satisfactory woven pin seam in the conventional fabric depends to a large extent on the pre-set crimps of the folded back projecting warp strands being substantially compatible with the crimp pattern of the fabric. This in turn depends on the crimp pattern of the warp being symmetrical so that when the warp strands are folded back and interwoven and are therefore reversed and inverted, their crimps will still follow the crimp pattern of the cut-back warp strands of the fabric with which they are aligned. This concept is explained in U.S. Pat. No. 4,026,331 which is restricted to a woven pin seam in single layer forming fabric in which the folded back warp strands have an inherent crimp which is compatible with the crimp pattern of the fabric. In those cases where the top crimps are different in length from the bottom crimps, but are otherwise symmetrical, each projecting warp strand may be rotated 180° about its longitudinal axis to render the crimp of the folded back strand compatible. Some adjustment is usually made at the loop of each strand and this will influence the length of the loop.

It has heretofore been very difficult, if not impossible, to make a woven pin seam in fabric having a complicated and unsymmetrical mesh pattern. This difficulty is acknowledged in U.S. Pat. No. 4,206,787 commencing at Column 1, line 61. In these fabrics the warp crimp configuration at the top surface of the fabric may be quite different from that at the bottom surface and the upslope of the crimp may be different from the downslope within the fabric so that when the warp projections are looped and, even inverted, they will not fit readily into the crimp pattern when re-woven into the reconstituted fabric of the seam area. In some cases it may be possible to strain the crimps so that the re-woven ends of wrap can be forced into place but this usually results in the formation of some pintle loops that are either too long or too short and it can also result in gross distortion of the cloth at the seam area. When alternately long and short pintle loops are symmetrically formed without gross distortion of the fabric, two pintles may be used to join the ends of the fabric, each one passing through the short loops of one end and the long loops of the other end of the fabric. The use of two pintle pins, however, is a disadvantage, particularly in the case of a wide fabric because of the difficulty of inserting both pintle pins. In cases where there are minor differences in pintle loop lengths the pin seam is weakened because of the tendency for the stress to be taken only by those loops which are shorter in length.

In making a pin seam according to the known method described above, it is usual practice for pairs of consecutive warps to form retainer loops and alternate pairs of consecutive warps to form pintle loops. In a symmetrical mesh pattern, such as for example, a 4-shed duplex weave pattern having two layers of weft, the weaving back of the looped warp strands is not too difficult and the loops formed from alternate pairs of warps are substantially the same length because similar pairs form similar loops. In the case of non-symmetrical 4-shed weaving patterns, difficulty in weaving back can usually be overcome by rotating the strands at the loops. In the case of some meshes, however, weaving back and maintaining even loop sizes is prevented by substantial differences in crimp configuration at the loop. This difficulty is particularly apparent, for example, in 6-shed double layer-fabric in which the weaving pattern is repeated every third pair of warp strands and when every second pair is taken to form either a retaining loop or a pintle loop it is found that similar pairs must form retaining loops and pintle loops alternately. Thus, in order for the crimps of the looped warp to be more or less compatible with the crimp pattern of the fabric, there will be some variation in the lengths of each type of loop making it virtually impossible to obtain a satisfactory seam and certainly not a single pintle seam.

It has unexpectedly been found that when the warp is flattened according to the aforementioned patent application, Ser. No. 140,475, it can be woven back into the added weft strands of the end portion of the fabric without regard to the crimp configuration, without having to be twisted at the loops and also without variation in loop size. The present invention therefore is to provide a single pintle woven pin seam in all-monofilament dryer fabric having flattened warp strands.

SUMMARY OF INVENTION

A feature of the invention is that a single pintle woven pin seam may be made without rotating the strands at the loops.

A further feature of the invention is that all the projecting warp strands to form retaining and pintle loops may be woven back in non-conforming pattern and that the loops can emerge from the reconstituted fabric of the seam area in any position relative to the terminal added weft strands at the end edges.

A still further feature of the invention is that retaining loops and pintle loops may be alternated without regard to the weaving shed pattern of the fabric. Also, as in the case of some uneven weaving patterns for example, the weft retaining loops may pass around the last weft strand and cross over, under or within alternate pintle loops. That is to say, a warp strand forming a retaining loop may emerge at one side of a re-constituted or re-woven end portion between two consecutive pintle loops and re-enter the fabric at the other side of the re-woven end portion between the next two consecutive pintle loops, passing around the last added weft strand and crossing over, under or within the intervening pintle loop, depending on which way the intervening pintle loop emerges from and re-enters the fabric.

According to the above features, from a broad aspect, the present invention provides a woven all-synthetic monofilament dryer fabric for use in a paper-making machine. The fabric is constituted by a belt woven with warp and weft strands with the warp strands extending in the machine direction. The belt is interconnected at opposed ends by a woven single pintle pin seam to form an endless belt. The warp strands in at least rewoven end portions of the belt are flattened strands.

Also, according to the above features, to provide for a plurality of loops at each end of the fabric a predetermined number of weft strands is removed and selected projecting warp strands are looped and woven back into a reconstituted fabric formed with added crimped weft strands, selected loops forming in turn retaining loops of equal size and pintle loops of equal size, characterized in that the flattened projecting warp strands are woven back into the added weft strands without regard to their pre-set crimp configurations or the crimp pattern of the fabric.

Also, according to the above features there is provided a method of making a plurality of pintle loops at each end of a woven synthetic monofilament dryer fabric in which the wrap strands in at least the area of each said end are flattened, said method comprising the following steps:

(1) removing a predetermined number of weft strands from an area at the end of the fabric and leaving a plurality of projecting warp strands each pre-crimped in the configuration of the crimp pattern of the fabric, (2) selecting pairs of projecting warp strands to form in turn, but not in sequence, retaining loops and pintle loops, (3) looping and weaving back into a group of added crimped weft strands, without regard to the crimp configuration already existing in the warp strand, one of each selected pair of projecting warp strands; the other of each pair being woven part way into the added weft strands to meet the looped strand at a predetermined location within the group of added weft strands thus forming retaining loops and pintle loops at a re-woven end portion of the fabric, said retaining loops being uniform in tightness and said pintle loops being uniform in size.

Also, according to the above features of the invention there is provided a method wherein the selected pairs of projecting warp strands are alternate pairs of adjacent warp strands which form in turn retaining loops and pintle loops, said retaining loops being uniform in tightness and said pintle loops being uniform in size.

Again, according to the above features of the invention, the selected pairs of warp strands forming pintle loops may themselves be grouped in pairs to form tandem pintle loops with intervening retaining loops formed therebetween. In this way the joint is strengthened because $\frac{2}{3}$ of the warp strands available to form loops are formed into pintle loops.

As a further measure, to hold the pairs of pintle loops in extended tandem alignment and facilitate intermeshing of pintle loops for insertion of the pintle to close the joint, the pairs of pintle loops are drawn together by supplementary flexible strands at each side of the extreme edge of the fabric, the flexible strands being interwoven around the pairs of pintle loops and cross each other between the pairs within the intervening retaining loops. The flexible strands are preferably multifilament strands.

BRIEF DESCRIPTION OF DRAWINGS

The invention will now be described, by way of example, with reference to the accompanying drawings which illustrate a single embodiment.

DESCRIPTION OF PREFERRED EMBODIMENTS

Figure 1:
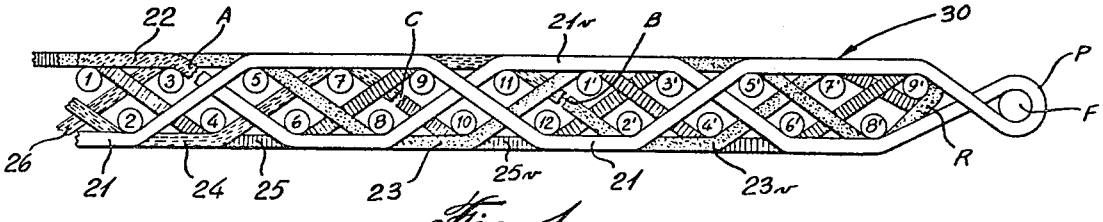
FIG. 1 is an enlarged sectional side view of an end portion of a 6-shed duplex dryer fabric with flattened warp prepared for a pin seam according to the invention.

Referring to FIG. 1 there is shown a reconstituted end portion 30 of a 6-shed 12 repeat pattern duplex dryer fabric prepared for a single pintle pin seam. A set of added weft strands 1 to 12, repeating as 1', 2', 3' etc., is shown in cross-section. Warp strands 21 to 26, repeating as 21', 22', 23' etc., are flattened in the ratio of about 2:1 and are shown as they are interwoven with the added weft strands in each repeating pattern of six consecutive warp strands. Odd numbered warp strands 21, 23, 25 etc., have been selected and are looped and re-woven back into the added weft strands as *21r*, *23r*, *25r*, *21'r* etc., to form alternatively pintle loops P which are bent around forming rod F and retaining loops R which are bent around the last added weft strand 9'.

Figure 2:
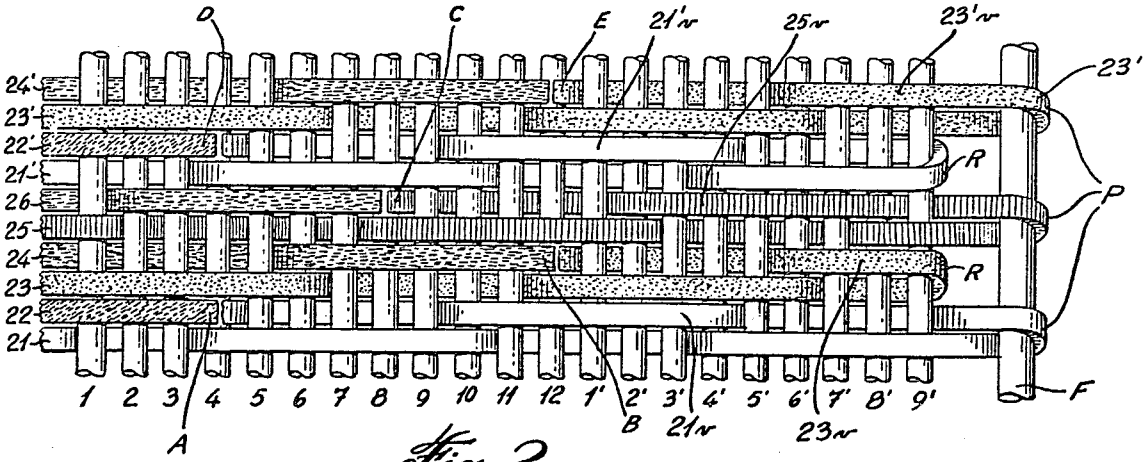
FIG. 2 is a plan view of the upper surface of the end portion shown in FIG. 1.

As shown in FIG. 2, the woven back warp strands are placed as extensions of their adjacent even numbered warp strands 22, 24, 26, 22' etc., which have been woven only part way into the added weft strands and are terminated at positions shown at A, B, C, D and E in a predetermined pattern. The woven back warp strands are terminated at these positions also to form abutting termination points of the odd and even numbered warp strands.

The added weft strands 1, 2, 3 etc., are the same strands that were previously removed from the ends of the fabric, or are identical to these so that, when re-woven by the warp into the reconstituted fabric portion 30, the crimp pattern of the fabric is maintained.

This method of weaving-in pintle loops for a pin seam is known in the art and, while it has been successfully used for some uncomplicated and symmetrical weave patterns in conventional fabric, it has heretofore not been possible to use it for making woven single pintle pin seams in the 6-shed duplex fabric shown in the drawings or in some other complicated and/or unsymmetrical weave patterns as will now be explained with the aid of the drawings.

It will be seen in the weaving pattern of FIG. 1 that the warp crimps which appear at the top surface of the fabric span seven weft strands, while those that appear at the bottom surface span only five weft strands. The warp strands are therefore not symmetrical in respect to consecutive crimps. If these strands were round the crimps would resist being deformed and some difficulty would be experienced with re-weaving after the strands were looped unless they were rotated about their central axes by 180° at the loop to reverse the sequence of long and short crimps. In cases of unsymmetrical warp crimp patterns, such as those in which the crimp configuration at the top side is vastly different to that at the bottom side, rotating the strands at the loops would, of course, not help. A further problem arises with the mesh shown because warp strands that form all the pintle loops, for example, do not have the same crimp configuration as they emerge beyond the last added weft strand of the reconstituted fabric. Thus, if the warp crimps are set and not easily changeable, while the crimps of the loaded strands will generally fall into place in the fabric, the consecutive loops of the same kind, will naturally be formed at different lengths. For example, referring again to the drawings, warp strand 21 which forms a pintle loop emerges from the fabric over the last added weft strand 9', passes under around and over forming rod F and re-enters the mesh under weft strands 8' and 9'. Assuming the crimp of the warp strand to be permanent the length of the loop around F would be determined by the position of the crimps of woven-back warp 21*r* relative to the crimp pattern of the fabric at that position. Warp strand 25 which forms the next consecutive pintle loop emerges from the fabric over added weft strand 9' and re-enters the fabric under weft 9' but in a different sequence relative to the crimp configuration of the strand end when 25 assumes its position in the crimp pattern of the fabric as 25*r* the length of its loop will therefore not be the same as the loop formed by strand 21. Again warp strand 23' which forms the third consecutive pintle loop emerges from the fabric under added weft strand 9', passes around F and re-enters the fabric over weft 9' thus forming a third variation in pintle loop length when it is re-woven as 23'*r*.

It will be seen therefore that if the crimps of the warp strands are substantially permanent as they would be with conventional round warp so that the woven-back warp strands must conform to the crimp pattern of the fabric, there would be at least three different lengths of pintle loops. The same condition applies to the retaining loops and a resulting woven pin seam would obviously not be satisfactory. At attempt to equalize the loop lengths by forcing the warp crimps to conform would either cause unacceptable distortion in the reconstituted area of added wefts or such gross distortion of the woven back strands that it would actually be impossible to continue weaving them into the added weft strands.

Figure 3:
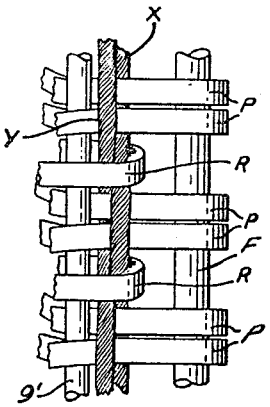
FIG. 3 is a plan view of the upper surface of the extreme end portion showing a modification of the seam.

In FIG. 3 the warp strands are shown to have been selected to form pairs of pintle loops P extending from the ends of the fabric. Retaining loops are looped around the last added weft 9', between the pairs of pintle loops. Supplementary flexible strands X and Y are interwoven around the pairs of pintle loops from top side to bottom side of the fabric in such a way that they cross each other between the pairs of pintle loops and underlie the retaining loops where they cross as shown. The flexible strands in this way bind the pairs of pintle loops together and hold them in extended tandem alignment.

According to the invention, when the warp strands that are to be looped and re-woven into added weft strands are flattened they will then be found to adapt themselves to the crimp pattern of the reconstituted fabric thus formed, regardless of their inherent crimp configuration, and the lengths of the loops may be equalized as shown in the drawings.

The flattened monofilament strands of the present invention would have a substantially rectangular cross-section with the long axis of the flattened section extending parallel to the plane of the fabric when woven. A possible cross-sectional area range would be from 0.07 square mm to 0.5 square mm and a possible ratio range of the long axis to the short axis would be 1.5:1 to 3:1.

The fabric of the invention would not be restricted to any particular weaving pattern but would have a warp count preferably in the range of 11 to 40 strands per centimeter and a weft count preferably in the range of 4 to 40 strands per centimeter.

It is not intended to restrict the invention to dryer fabrics having flattened warp throughout for it is possible to substitute flattened warp for round warp in added weft strands in a reconstituted area of fabric at each end of a dryer fabric in order to make a satisfactory single pintle woven pin seam according to the invention.

I claim:

1. A woven all-synthetic monofilament dryer fabric for use in a paper-making machine, said fabric being constituted by a belt woven with warp and weft strands with said warp strands extending in the machine direction, there being at least two weft layers and said warp strands being crimped relative to said weft strands in a non-symmetrical pattern, said belt being interconnected at opposed ends by a woven single pintle pin seam formed by reversely turned warp strands to constitute an endless belt, said warp strands in at least re-woven end portions of said belt being flattened strands with the original crimp configuration being changed in reversely turned portions of said reversely turned warp strands.

2. A fabric as claimed in claim 1 wherein said fabric is constituted by at least two layers of weft strands.

3. A fabric as claimed in claim 1 wherein selected ones of said warp strands in said re-woven end portions form loops at end edges of said belt, said loops being interdigitated to receive a common single pintle pin therethrough to secure both ends of said belt together, others of said warp strands being re-woven back into said end portions with weft strands to form retaining loops to retain an end weft in position.

4. A fabric, as claimed in claim 3 wherein all of said warp strands in said re-woven end portions of said belt are flattened warp strands, a predetermined number of weft strands in end portions of said belt having been removed and woven back with said warp strands to constitute said re-woven end portions, alternate ones of said warp strands projecting beyond said woven back weft strands for forming said pintel loops and weft strand retaining loops, said warp strands between alternate warp strands forming pintle and retaining loops being foreshortened in said re-woven end portions, said reversely turned and woven back portions of said alternative warp strands being aligned with respective ones of said foreshortened warp strands, said reversely turned portions of said flattened warp strands being woven back into said end portions without regard to their pre-set crimp configuration or the crimp pattern of the fabric.

5. A fabric as claimed in claim 4 wherein said severed warp strands in said re-woven end portions are severed at staggered locations in a predetermined pattern along the length of said re-woven end portions, said woven back portions of said loop forming warp strands terminating in end-to-end termination points with said respective ones of said severed warp strands.

6. A fabric as claimed in claim 4 wherein said flattened warp strands have a substantially rectangular cross-section with the long axis of the flattened cross-section extending parallel to the plane of the fabric.

7. A fabric as claimed in claim 3 wherein all of said warp strands in said re-woven end portions of said belt are flattened warp strands, a predetermined number of weft strands in end portions of said belt having been removed and woven back with said warp strands to constitute said re-woven end portions, selected ones of said warp strands projecting beyond said woven back weft strands for forming said pintle loops and weft strand retaining loops, said loop forming warp strands reversely turned portions being woven back in said re-woven end portions in alignment with and in abutment with other selected foreshortened warp strands terminating within the re-woven end portions, said reversely turned portions of said flattened warp strands having been woven back into said end portions without regard to their pre-set crimp configuration or the crimp pattern of the fabric.

8. A fabric as claimed in claim 7 wherein said severed warp strands in said re-woven end portions are severed at staggered locations in a predetermined pattern along the length of said re-woven end portions, said woven back portions of said loop forming warp strands terminating in end-to-end termination points with said respective ones of said severed warp strands.

9. A fabric as claimed in claim 7 wherein said flattened warp strands have a substantially rectangular cross-section with the long axis of the flattened cross-section extending parallel to the plane of the fabric.

10. A fabric as claimed in claim 9 wherein said flattened warp strands are flattened in the ratio of about 2:1.

11. A fabric as claimed in claim 9 wherein the ratio range of the long axis to the short axis of said flattened cross-section is 1.5:1 to 3:1.

12. A fabric as claimed in claim 9 wherein the cross-sectional area range of said flattened warp strands is from 0.07 square mm to 0.5 square mm.

13. A fabric as claimed in claim 3 wherein said pintle loops are formed by pairs of adjacent warp strands and held in position by a flexible strand binding.

14. A fabric as claimed in claim 13 wherein said flexible strand binding is comprised by supplementary flexible strands at said opposed ends interwoven around said pintle loops, said supplementary flexible strands crossing each other between said pintle loops and extend within said retaining loops.

15. A fabric as claimed in claim 14 wherein said supplementary flexible strands are multifilament strands.

16. A method of making a plurality of pintle loops at each end of a woven synthetic monofilament dryer fabric having at least two weft layers and the warp strands are crimped relative to the weft strands in a non-symmetrical mesh pattern and in which the warp strands in at least the area of each said end are flattened, said method comprising the following steps:

(1) removing a predetermined number of weft strands from an area at the end of the fabric and leaving a plurality of projecting warp strands each pre-crimped in the non-symmetrical configuration of the crimp pattern of the fabric, (2) selecting pairs of projecting warp strands to form in turn, but not in sequence, retaining loops and pintle loops, (3) looping and weaving back into a group of added crimped weft strands, without regard to the prior crimp configuration already existing in the warp strand, one of each selected pair of projecting warp strands; the other of each pair being woven part way into the added crimped weft strands of the group to meet the looped strand at a predetermined location within the group of added crimped weft strands thus forming retaining loops and pintle loops at a re-woven end portion of the fabric, said retaining loops being uniform in tightness and said pintle loops being uniform in size.

17. A method as claimed in claim 16 wherein said step (2) comprises selecting alternate pairs of adjacent warp strands to form said retaining and pintle loops, said retaining loops being uniform in tightness and said pintle loops being uniform in size.

* * * * *